US010781626B2

(12) United States Patent
Wieczorek et al.

(10) Patent No.: US 10,781,626 B2
(45) Date of Patent: Sep. 22, 2020

(54) CORNER FLASHING FOR A WINDOW OR DOOR OPENING

(71) Applicant: Knauf Gips KG, Iphofen (DE)

(72) Inventors: Thomas Wieczorek, Mainbernheim (DE); Jürgen Böhringer, Dürnau (DE); Kerstin Schöneberger, Cadolzburg (DE)

(73) Assignee: Knauf Gips KG, Iphofen (DE)

( * ) Notice: Subject to any disclaimer, the term of this patent is extended or adjusted under 35 U.S.C. 154(b) by 11 days.

(21) Appl. No.: 15/804,166

(22) Filed: Nov. 6, 2017

(65) Prior Publication Data

US 2018/0058136 A1 Mar. 1, 2018

Related U.S. Application Data

(63) Continuation of application No. PCT/EP2016/000692, filed on Apr. 29, 2016.

(30) Foreign Application Priority Data

May 6, 2015 (DE) ..... 10 2015 005 684
Sep. 2, 2015 (DE) ..... 10 2015 011 301

(51) Int. Cl.
*E06B 1/62* (2006.01)
*E06B 7/14* (2006.01)

(52) U.S. Cl.
CPC ..... *E06B 1/62* (2013.01); *E06B 7/14* (2013.01); *E06B 2001/628* (2013.01)

(58) Field of Classification Search
CPC ..... E06B 1/62; E06B 7/14; E06B 2001/628
See application file for complete search history.

(56) References Cited

U.S. PATENT DOCUMENTS 6,401,401 B1 * 6/2002 Williams ..... E06B 1/62 49/471
2006/0101726 A1 5/2006 Collins
(Continued)

FOREIGN PATENT DOCUMENTS

DE 10310326 B4 * 5/2013 ..... E06B 1/62
EP 1424455 A1 * 6/2004 ..... E04D 13/1475
JP 2012172449 A * 9/2012

OTHER PUBLICATIONS

Transmittal of International Search Report and Written Opinion issued in International application PCT/EP2016/000692 from which this application claims priority, dated Aug. 8, 2016.
(Continued)

*Primary Examiner* — Basil S Katcheves
*Assistant Examiner* — Omar F Hijaz
(74) *Attorney, Agent, or Firm* — Falk Ewers; Ewers IP Law PLLC

(57) ABSTRACT

A corner section for installing a window or door frame in a sealing system is disclosed. The corner section has a corner region of a trough or a tanking, i.e., it is open on two sides and bent upwards on two sides to form a tanking. When installed, the corner region encloses a corner of a window frame or door frame and is in contact with the reveal. The open sides are positioned in horizontal window direction and face the outside of the reveal. The corner section ensures that the system is sealed against driving rain and provides for a second water-drainage level in the system.

13 Claims, 3 Drawing Sheets

(56) References Cited

U.S. PATENT DOCUMENTS

| | | | | |
|---|---|---|---|---|
| 2014/0250801 | A1 | 9/2014 | Knollmeyer | |
| 2015/0047269 | A1* | 2/2015 | Messenger | E06B 7/14 52/58 |

OTHER PUBLICATIONS

Knauf Manual "Warm-Wand Fensterabdichtungssystem" for the installation of windows using a sealing corner sections, dated May 2017, and an English-language machine translation thereof.
Office Action dated Jan. 17, 2020 issued in European counterpart application No. 16723654.6 in English.

* cited by examiner

CORNER FLASHING FOR A WINDOW OR DOOR OPENING

CROSS REFERENCE TO RELATED APPLICATIONS

This application is a continuation of International Application No. PCT/EP2016/000692, filed Apr. 29, 2016, which claims priority to German patent application DE 10 2015 005 684.0, filed May 6, 2015, and to German patent application DE 10 2015 011 301.1, filed Sep. 2, 2015, the entire content of these applications being incorporated herein by reference.

TECHNICAL FIELD

The invention relates to a corner section for sealing windows and doors against driving rain as well as an associated sealing system.

BACKGROUND

Windows or doors are fitted into openings of unfinished buildings, wherein these openings are usually larger than necessary in order to allow for fitting tolerances. This leads to the creation of gaps between window and door frames and the reveal, which must then be separately closed and sealed. The aim is to create a second sealing level, in addition to the sealing level of individual components. In order to achieve a watertight seal, in particular against driving rain, it is known to use rubber strips, which have to be cut to size, glued down and fitted manually with a great deal of effort. Since the gaps are three-dimensional, a great deal of pulling and folding of the strips is required, in order to ensure a contiguous seal. Each workman has his own method for accomplishing this task.

Doors and windows which claim to be waterproof against driving rain must comply with DIN EN 12208 and/or DIN EN 1027. This standard specifies that a test body, when subjected to a water pressure of 600 Pa or higher for at least 5 minutes, does not show any ingress of water.

A problem in this context is that although individual components such as windows, doors, window sills or the rubber sealing strip may individually meet these requirements, the overall bond still remains untested. This problem is based on the fact that it is not possible to test in advance the water-tightness of the bond between the window or door and the window reveal/the other associated parts such as the window sill, so that ultimately the effectiveness of the overall bond depends upon the skill of the specialists involved. This includes window manufacturers, facade installers and, as the case may be, sill specialists. The sealing of doors and windows is therefore a task spanning a number of trades, without being able to refer to any clear directions, as to how water-tightness against driving rain can be achieved.

SUMMARY

Therefore, it is an object of the invention to find a way of improving and ensuring the quality of window and door-frame installation with regard to water-tightness against driving rain. A greater reliability of the process involved is to be achieved.

BRIEF DESCRIPTION OF THE DRAWINGS

The invention will now be described with reference to the drawings wherein.

DESCRIPTION OF EXEMPLARY EMBODIMENTS

Figure 1:
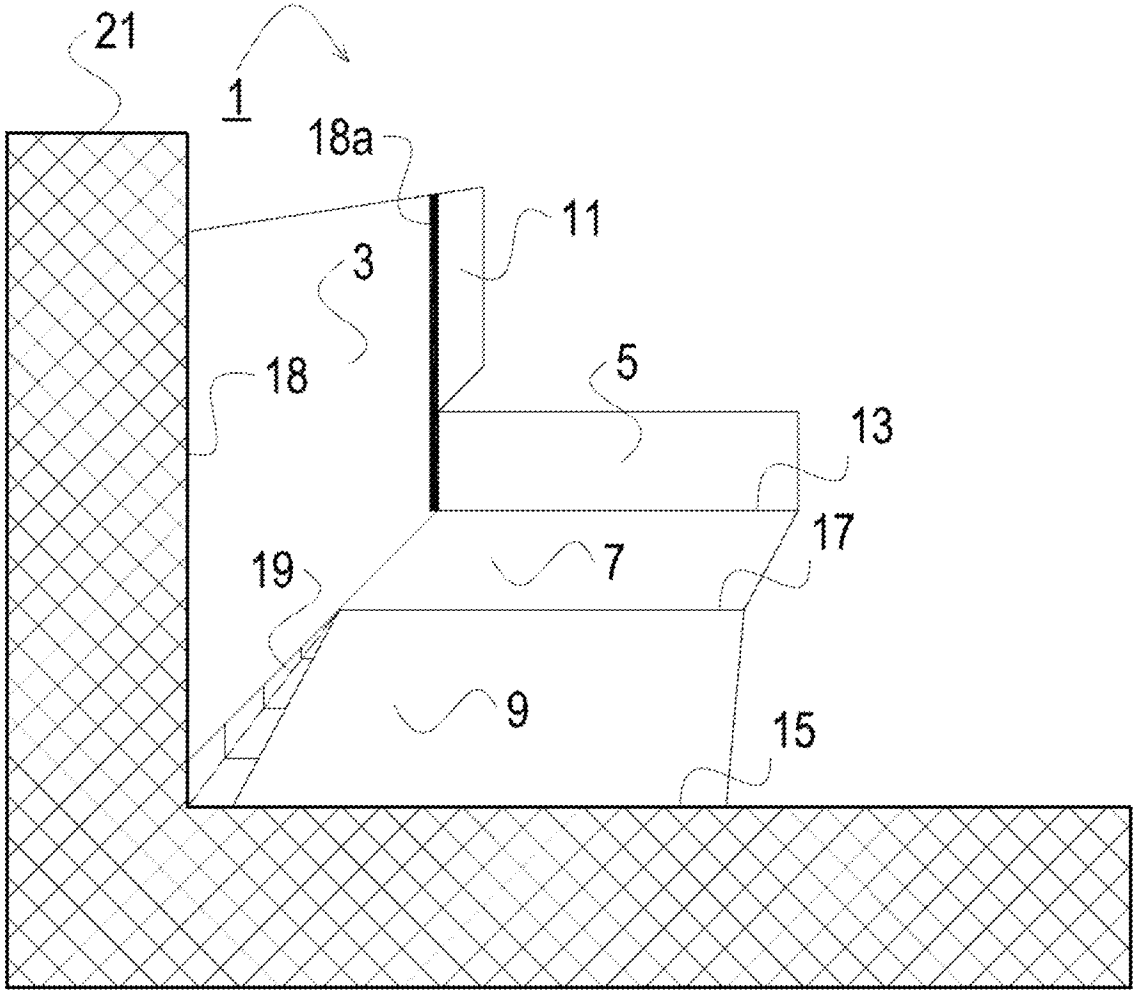
FIG. 1 shows a top view of a corner section.

The corner section 1 comprises a corner region of a trough or a tanking, i.e., it is open on two sides and bent upwards on two sides to form a tanking, see FIG. 1. Specifically, FIG. 1 shows an embodiment of a corner section according to the invention in a top view. When installed the corner region encloses a corner of a window frame or door frame and is in contact with the reveal. The open sides are positioned in horizontal window direction and face the outside of the reveal.

When installed, one edge of the tanking is arranged on the inside, i.e., on the side of the window pointing towards the interior. This side of the window or door frame will from here be called the "inside," the edge of the tanking arranged on the inside of the window or door frame will from here on be called the "inner tanking edge" 5. The side opposite the inside of the window or door frame is called the "outside." One tanking edge extends laterally along the window frame and is in contact with the reveal 21. This tanking edge will from here on be called "the lateral tanking edge" 3.

The tanking edges 3, 5 are connected, at least in sections, in a watertight fashion, with the inside of the window or door frame, the side of the window or door frame and the lateral reveal 21. The bottom section 7, 9 of the corner section 1 extends below the window or door frame from the inside to the outside of the window or door frame and beyond. On the outside the tanking bottom 9 may be hidden by a window sill. A window or door frame fitted into such a corner section in a sealing manner is called a sealing system in terms of this invention.

On the inside of the window or door frame, on the side of the window frame and the reveal 21, the tanking edges 3, 5 may be connected in a watertight fashion preferably with a bonding agent, in particular with an adhesive. In a preferred embodiment of the invention, self-adhesive layers are applied in appropriate areas of the corner section, i.e., in those areas of the corner section, which are to be glued down.

If the corner sections according to the invention are provided on both sides of the window or door frame and if the gap below the window or door frame is glued down using a watertight strip, which strip is also connected on the inside of the window or door frame to the same in a watertight fashion, a large tanking open on one side towards the outside is created, in which the window or door frame is received completely, and any water which might intrude is diverted to the outside, in direction of the façade side.

In this way a second water-drainage level is created behind and below the first water-drainage level, wherein the first level is formed by individual components, i.e., the window/door, the window reveal and possibly the window sill.

The corner section comprises or consists of a water-impervious material. Especially preferably the material is elastic, for example rubbery, thereby allowing it to be adapted to shape around the external frame by means of bending to the required extent. Preferably, the material is not subjected to any major mechanical stress during bending, i.e., not distorted or folded.

According to an advantageous further development of the invention, the bottom of the corner section has a length and at least two widths 13, 15. The length extends vertically to the inner tanking edge 3, which is connected, when installed, to the inside of the window or door frame, as far as the open, outwardly pointing tanking edge.

The first width 13 extends along the inner tanking edge, starting from the corner towards the open side. The corner is formed at the point, where the inner and lateral tanking edges 3, 5 come together.

The second width 15 extends in parallel to the first width 13 along the open tanking edge which lies opposite the inner tanking edge. It is measured vertically to the lateral tanking edge 3. The second width is preferably wider/greater than the first width.

A wider second width 15 has the advantage that the corner section 1 is wider in the outer area than in the inner area. This permits the corner section 1 in the inner area to be placed in touching contact against the side of the window or door frame, and at the same time to be placed against the reveal 21, which, of course, due to the mounting tolerances is larger than the window or door frame.

Because the first and second width 13, 15 have different dimensions, the bottom of the corner section is fan-shaped, i.e., it increases in width towards the outside. The bottom 9 is therefore fan-shaped, at least in sections. The additional material contained in the fan 19 makes it possible to bridge the gap between window or door frame and the reveal. Instead of, or in addition to, the widened bottom, a greater height 18 of the lateral tanking edge may also be provided in the outer area compared to the inner area. This embodiment makes it possible to fold or bent the outer floor region over. By folding this area over in a downward direction, a run-off for the water of the second water-drainage level is formed. In addition, folding this area over may be necessary, in order to be able to install a sloping window sill.

Especially preferably, the corner section 1 comprises three widths. The third width 17 extends along the intersection of the outside of the window or door frame with the bottom region of the corner section, when installed. Also especially preferably, the first width 13 and the third width 17 have the same dimensions, which means that the fanned area of the floor is to be found only between the third 17 and the second width 15. This embodiment has the advantage that the areas of the corner section wrapping around the window frame have a constant width analogue to the window frame. The material of the corner section therefore does not require any folding or pulling in order to achieve a tight fit against the contour of the window frame. In this way it is possible to avoid any places, where there could be an inadvertent ingress of water.

According to a further preferred embodiment of the invention, the lateral tanking edge 3 behind and above the corner formed with the inner tanking edge 5 extends for a few more centimeters beyond the tanking. The lateral tanking edge 3 therefore comprises an overhang 11 lengthening the lateral tanking edge 3 beyond the corner past and above the corner formed with the inner tanking edge. This embodiment is especially helpful then, when the window or door frame is placed onto a mounting profile and the mounting profile is also received in the tanking. The mounting profile is narrower than the window or door frame. In order to ensure that the lateral tanking edge 3 can cover the entire width (in cross-section) of the window or door frame and so that, at the same time, the inner tanking edge 5 can be connected to the mounting profile in a watertight manner on the inside, the lateral tanking edge must continue beyond the corner, i.e., comprise an overhang 11.

Preferably, this overhang is dimensioned such that it has a width of at least a few millimeters, preferably of 0.5 cm to 5 cm, especially preferably of 0.5 cm to 2 cm. Should this overhang, after installation, be too wide, then the surplus can be cut off. The overhang is provided for the purpose of universal use, because the dimensions of window width and mounting profile can vary from one manufacturer to the other.

Figure 2:
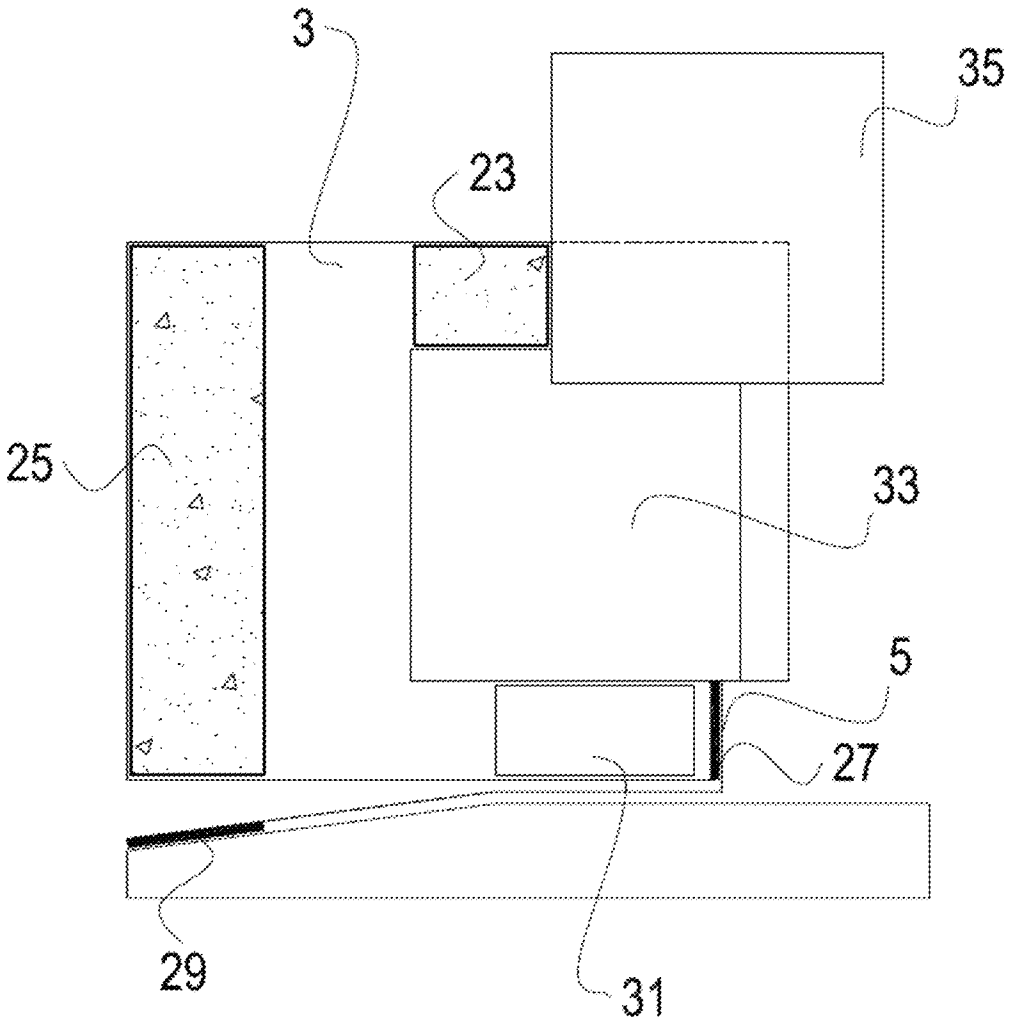
FIG. 2 shows a side view of a corner section.

FIG. 2 shows a side view of the embodiment of the invention according to FIG. 1. Adhesive surfaces are shown as shaded areas or as lines in the sectional view. Preferably, adhesive surfaces are located in the corner region on the inside of the lateral tanking edge 3 (adhesive surface 23), on the outside of the lateral tanking edge 3 (adhesive surface 25), on the inside of the inner tanking edge 5 (adhesive surface 27) and on the underside of the tanking bottom (adhesive surface 29) in the area between the second and the third width 15, 17.

The adhesive surface 23 is used for gluing the corner section 1 flat to the lateral surface of the window or door frame. The adhesive surface 25 ensures a waterproof connection between the corner section 1 and the reveal. The adhesive surface 27 forms the connection of the corner section 1 with the inner window frame or preferably with the mounting profile. The adhesive surface 29 attaches the corner section 1 to the sill.

The adhesive surfaces may be applied to the corner section as early as in the factory and protected, e.g., by a pull-off film, until they are put to use. Alternatively, it is possible to supply the adhesive separately for on-site application to the respective appropriately dimensioned surfaces. Or there could be a combination of both, i.e., there could be surfaces to which the adhesive has been applied in the factory and there could be adhesive agents to be applied on-site. In other words, areas not yet treated with adhesive in the factory, could be glued down on-site, and thereby adapted individually to the on-site situation.

The corner section is preferably formed in one piece. In terms of the invention, "in one piece" means that the corner section has been formed from a single piece of material, e.g., a sealing film or a sealing strip.

However, the corner section may also be formed of a number of pieces, i.e., by connecting a number of single pieces together. Different-sized parts cut from a sealing film or sealing strip may be joined together in a watertight fashion to form the finished corner section. This embodiment of the invention has the advantage of being able to map complex geometries in a simple manner.

Individual pieces can be joined together, e.g., by gluing, or preferably by welding, or by vulcanizing. In this context the most important thing is to achieve a connection which is watertight even when subjected to water pressure.

A corner section according to the invention can be manufactured by means of various forming processes. For example, the corner section 1 could be manufactured by means of deep-drawing or injection molding.

The process of gluing or welding individual sealing films or sealing strips together is another possibility. Here the corner section can be manufactured from a single piece or from a number of pieces. A single-piece corner section can be achieved by folding the film or strip and gluing or welding the folds together. Preferably, the "surplus" material left over after folding is not removed, i.e., not cut off. In this way, ingress of water can be prevented, even if the connection is not absolutely watertight.

A second possibility of producing the corner section is deep-drawing the corner section from suitable film or strip-shaped water-impervious materials, which has the advantage of producing the corner section as one piece.

A further possibility of producing the corner section is to produce it by injection molding, which again allows the geometry of the corner section to be produced as one piece.

Suitable basic materials for the films, strips or injection moldings are, without restriction: elastomers and thermoplastics in general such as natural rubber or artificial rubbers, e.g., EPDM (ethylene propylene diene rubber), NBR (nitrile butadiene rubber), SBR (styrene butadiene rubber) or silicone rubber.

A specialist in the field of the manufacturing methods proposed will know of other materials suitable for this application and choose these on the basis of his specific knowledge.

Apart from the sealing corner section 1 described above the invention also covers a sealing system. The sealing system comprises a sealing corner section 1 as described above as well as a window or door frame. One corner of the window or door frame is fitted, with its lower mounting profile, into a corner of the sealing corner section 1 and connected, at least in sections, in a watertight fashion, to a lateral tanking edge 3 and an inner tanking edge 5 of the corner section 1. The corner is formed by the lateral tanking edge 3 and the inner tanking edge 5 as well as the tanking bottom 9.

It is particularly preferred if the sealing system comprises two corner sections 1, so that a further corner of the window or door frame can, with the lower mounting profile, be fitted into a corner of the second sealing corner section 1 and connected to the same, at least in sections, in a watertight fashion. In this way the two critical regions of a window or door frame, with respect to the ingress of water, can be provided with a second water-drainage level.

Figure 3:
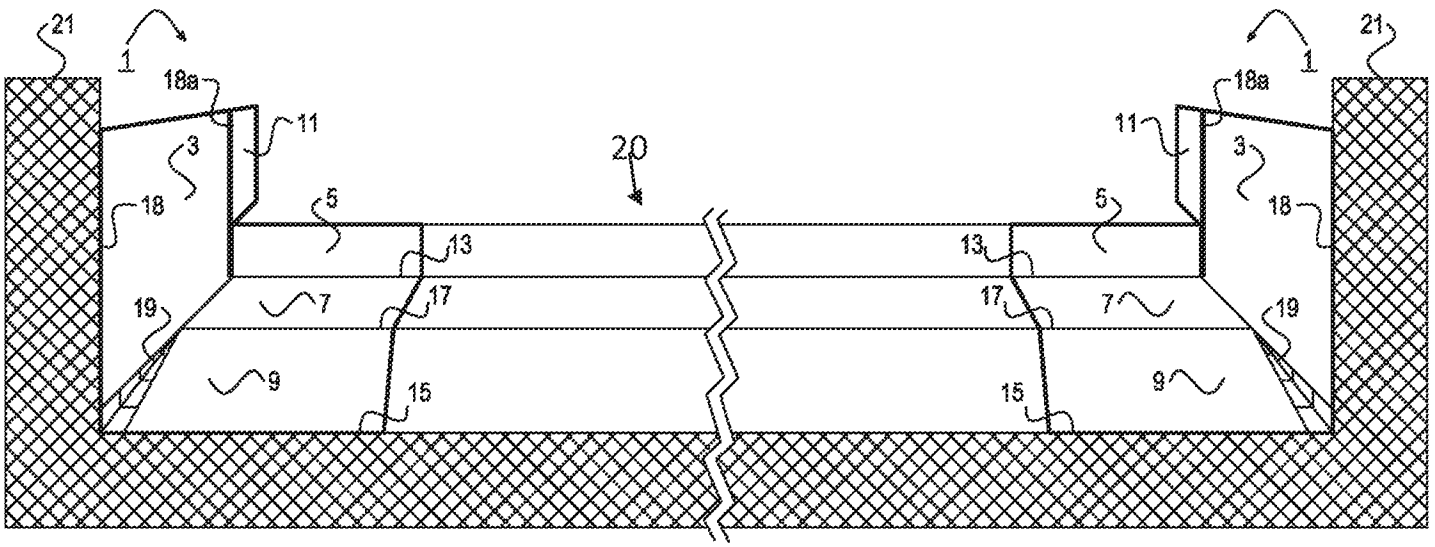
FIG. 3 shows a first and a second corner section having a bent sealing strip.

It is particularly preferred if the two corner sections 1 shown in FIG. 3 are connected with each other by an upwardly bent sealing strip 20, in particular glued together in a watertight fashion, thereby forming a tanking open on one side, in which the window or door frame with its mounting profile is received.

The foregoing description of the disclosure illustrates and describes the present disclosure. Additionally, the disclosure shows and describes only the exemplary embodiments but, as mentioned above, it is to be understood that the disclosure is capable of use in various other combinations, modifications, and environments and is capable of changes or modifications within the scope of the concept as expressed herein, commensurate with the above teachings and/or the skill or knowledge of the relevant art.

The term "comprising" (and its grammatical variations) as used herein is used in the inclusive sense of "having" or "including" and not in the exclusive sense of "consisting only of." The terms "a" and "the" as used herein are understood to encompass the plural as well as the singular.

All publications, patents and patent applications cited in this specification are herein incorporated by reference, and for any and all purpose, as if each individual publication, patent or patent application were specifically and individually indicated to be incorporated by reference. In the case of inconsistencies, the present disclosure will prevail.

LIST OF REFERENCE SYMBOLS

1 corner section
3 lateral tanking edge
5 inner tanking edge
7 bottom region between first width and third width
9 bottom region between third width and second width
11 overhang of the lateral tanking edge
13 first width
15 second width
17 third width
18 height of the lateral tanking edge at the free end
**18*a*** height of the lateral tanking edge in the corner
19 fan
21 reveal
23 adhesive surface
25 adhesive surface
27 adhesive surface
29 adhesive surface
31 mounting profile
33 window or door frame
35 window or door wing

What is claimed is:

1. A sealing corner section for installing a window frame or a door frame, the sealing corner section comprising:

a tanking bottom;

a lateral tanking edge surface arranged at a first section of a lateral edge of the tanking bottom;

an inner tanking edge surface arranged at an inner edge of the tanking bottom and an edge of the lateral tanking edge surface that is located adjacent to the inner edge and the first section of the lateral edge of the tanking bottom;

the tanking bottom having a first width and a second width extending in parallel relative to each other, the first width extending vertically to the lateral tanking edge surface along the inner edge of the tanking bottom, the second width extending vertically to the lateral tanking edge surface along an edge of the tanking bottom which lies opposite to the inner edge of the tanking bottom, and the second width being larger than the first width; and a fan-shaped portion arranged between the tanking bottom and the lateral tanking edge surface at a second section of the lateral edge of the tanking bottom, and a dimension of a fanning out of the fan-shaped portion being defined by the first width and the second width.

2. The sealing corner section according to claim 1, wherein the tanking bottom has a length which is measured in a direction perpendicular to the inner tanking edge surface between the inner edge of the tanking bottom and an edge of the tanking bottom opposite to the inner edge of the tanking bottom.

3. The sealing corner section according to claim 2, wherein the tanking bottom has a third width which lies between the first width and the second width.

4. The sealing corner section according to claim 1, wherein a height of the lateral tanking edge surface at an edge opposite to the edge of the lateral tanking edge surface located adjacent to the inner edge and the first section of the lateral edge of the tanking bottom and measured between the lateral edge of the tanking bottom and an edge of the lateral tanking edge surface opposite to the lateral edge of the tanking bottom is greater than a height of the lateral tanking edge surface measured along the edge of the lateral tanking edge surface located adjacent to the inner edge and the first section of the lateral edge of the tanking bottom between the lateral edge of the tanking bottom and the edge of the lateral tanking edge surface opposite to the lateral edge of the tanking bottom.

5. The sealing corner section according to claim 1, further comprising:

an overhang arranged at the edge of the lateral tanking edge surface located adjacent to the inner edge and the first section of the lateral edge of the tanking bottom and above the inner tanking edge surface, wherein the overhang is lengthening the lateral tanking edge surface beyond the inner tanking edge surface.

6. The sealing corner section according to claim 1, wherein the corner section includes self-adhesive adhesive layers.

7. The sealing corner section according to claim 1, wherein the sealing corner section is made of a water-impervious material.

8. A sealing system comprising:

the sealing corner section according to claim 1, and a window or door frame, wherein a corner of the window or door frame is fitted, with a lower mounting profile, into the sealing corner section and is connected in a watertight fashion, at least in sections, to the inner tanking edge surface and the lateral tanking edge surface of the sealing corner section.

9. The sealing system according to the claim 8, further comprising a second sealing corner section, wherein a second corner of the window or door frame is fitted with the lower mounting profile into the second sealing corner section and is connected with the same, at least in sections, in a watertight fashion.

10. The sealing system according to claim 9, wherein the sealing corner section and the second sealing corner section are connected with each other by a bent sealing strip, thereby forming a tanking system open on a side in which the window or door frame with the lower mounting profile is received.

11. The sealing corner section according to claim 3, wherein the third width has the same dimension as the first width.

12. The sealing corner section according to claim 7, wherein the sealing corner section is made of an elastic water-impervious material.

13. The sealing system according to claim 10, wherein the connection between the sealing corner sections and the sealing strip is watertight.

* * * * *